United States Patent [19]

Mayer

[11] 4,428,515

[45] Jan. 31, 1984

[54] KNIFE SCABBARD WITH INTEGRAL BLADE SHARPENER

[75] Inventor: Paul C. Mayer, Rothschild, Wis.

[73] Assignee: Oy Fiskars AB, Helsinki, Finland

[21] Appl. No.: 371,654

[22] Filed: Apr. 26, 1982

[51] Int. Cl.[3] ..... B26B 29/02

[52] U.S. Cl. ..... 224/232; 7/120; 30/138; 51/214; 224/253

[58] Field of Search ..... 224/232, 240, 242, 253; 30/138; 51/211 R, 241 R, 214; 76/82; 7/120

[56] References Cited

U.S. PATENT DOCUMENTS

| | | | |
|---|---|---|---|
| 1,173,549 | 2/1916 | Blair | 30/138 X |
| 2,767,530 | 10/1956 | Paldanius | 30/138 X |
| 2,791,831 | 5/1957 | Hollis | 30/138 |
| 2,852,897 | 9/1958 | Woodworth | 51/214 |
| 3,381,807 | 5/1968 | De Vaughn | 224/232 X |
| 3,576,278 | 4/1971 | Eastman | 224/232 |
| 3,676,961 | 7/1972 | Jackson | 30/138 X |

*Primary Examiner*—Allan N. Shoap
*Assistant Examiner*—Robert Petrik
*Attorney, Agent, or Firm*—James E. Nilles

[57] ABSTRACT

A belt-mountable scabbard for carrying a sportsman's knife comprises spaced apart walls defining an elongated recess for receiving and protecting the blade of a knife carried in the scabbard. A knife blade sharpener is permanently mounted on the scabbard and comprises a blade-receiving sharpening slot formed in the scabbard and a pair of angularly arranged abrasive elements permanently attached to a wall of the scabbard near the sharpening slot for making sliding engagement with the edge of a knife blade being moved in the slot to effect sharpening.

7 Claims, 13 Drawing Figures

KNIFE SCABBARD WITH INTEGRAL BLADE SHARPENER

BACKGROUND OF THE INVENTION

1. Field of Use

This invention relates generally to knife scabbards with integral blade sharpeners.

2. Description of the Prior Art

Knives used by sportsmen for hunting, fishing and other purposes are typically carried in a scabbard which can be attached to the belt of the user. For best service, it is desirable to sharpen the knife blade before use or as conditions require. Therefore, the user may carry in his pocket, pack or tackle box some type of blade sharpening device, such as a conventional small abrasive stone or two elongated cylindrical ceramic sharpening sticks which are detachably mounted on a base board and storable in a carrying case. Not infrequently, such sharpening devices are not at hand or are difficult or impossible to locate when needed, or even turn out to be lost. As a result, the knife sometimes goes unsharpened and the user is frustrated and upset. In multicomponent devices the possibility of component loss and breakage is another problem to consider.

The prior art contains numerous examples of knives and knife scabbards having blade sharpening means thereon or associated therewith and the following patents illustrate the state of the art.

U.S. Pat. No. 2,767,530 (issued 1956) shows a pair of angularly disposed abrasive elements permanently attached to a metal bracket at the top opening of a leather sheath for engagement by the knife blade. U.S. Pat. No. 3,307,756 (issued 1967) shows a rigid knife sheath which has a honing stone covering and secured to the exterior side thereof and available for sharpening the knife. U.S. Pat. No. 3,846,909 (issued 1974) shows a knife sharpener carried by a detachable portion of a knife handle which may be slid along the knife blade to effect sharpening. Other U.S. patents show sharpeners mounted on the knife sheath or in the knife handle and these patents are: U.S. Pat. Nos. 2,791,831 (issued 1957); 2,744,320 (issued 1956); 2,658,272 (issued 1953); 2,651,839 (issued 1953) and 2,416,929 (issued 1947). U.S. Pat. Nos. 4,091,691 (issued 1978); 3,774,350 (issued 1973); and 3,676,961 (issued 1972) and 3,861,246 (issued 1975) show a combined storage case and sharpener.

SUMMARY OF THE INVENTION

In accordance with the invention there is provided a scabbard for carrying a knife, such as is used by sportsmen for hunting or fishing, which scabbard is provided with knife blade sharpening means permanently mounted thereon. The scabbard may be provided with means such as a strap to enable it to be secured to clothing or gear worn by the user. The scabbard, which is fabricated of rigid material such as, for example, plastic, leather or other material, comprises rigid spaced apart walls defining an elongated recess or space for accommodating and protecting the blade of a knife carried in the scabbard. The knife blade sharpening means generally comprise a blade-receiving sharpening slot formed in the scabbard and blade sharpening abrasive means permanently attached to the scabbard and located near the sharpening slot for making sliding engagement with the edge of a knife blade being reciprocably moved in the sharpening slot to effect sharpening. The sharpening slot has an axis along which the knife blade is moved back and forth and this axis is transverse to the longitudinal axis of the scabbard. The blade sharpening abrasive means is fabricated of material hard enough to sharpen the edge of a knife blade, such as abrasive stone, ceramic or even tool steel. Preferably, the blade sharpening abrasive means comprises two abrasive members in the form of cylindrical ceramic rods which are disposed in V-shaped arrangement relative to each other and located at (and overlapping) an end of the sharpening slot. The slot is constructed and shaped so as to support the knife blade in desired positions during sharpening. In operation, the knife blade is inserted into the sharpening slot and moved reciprocably therein at an appropriate angle relative to the abrasive means so that the blade edge to be sharpened bears or wipes against the blade sharpening abrasive means. Such movement is repeated until the desired degree of sharpness is attained.

In one embodiment of the invention the sharpening slot is defined by two aligned elongated holes extending through the spaced apart scabbard walls which are opposite each other and two blade sharpening members in V-shaped arrangement and overlapping each other are located at the lower end of the sharpening slot on one of the scabbard walls. The axis of the sharpening slot extends transversely through the blade-receiving recess in the scabbard.

In a second embodiment of the invention the sharpening slot, which is open at one end, is defined by two aligned elongated holes which extend inwardly from an edge of the scabbard where the opposite scabbard walls are joined together into the blade-receiving recess.

In a third embodiment of the invention the sharpening slot, which is open at one end, extends inwardly from an edge of the scabbard into a solid portion thereof but does not intersect the blade-receiving recess.

A knife scabbard having knife blade sharpening means mounted thereon or integral therewith in accordance with the invention offers several advantages over the prior art. For example, since the blade sharpening means are, in effect, an integral part of the scabbard, the blade sharpening means are always at hand when needed and cannot be lost or displaced. The arrangement eliminates the need for a separate storage compartment or support for the blade sharpening means. The scabbard also serves as a convenient, safe and easily held holder for the blade sharpening means thereon when a knife is being sharpened.

The location, configuration, arrangement and construction of the sharpening slot and the associated blade sharpening abrasive means ensure that the knife blade assumes the correct angular position relative to the abrasive means as the blade is moved or drawn through a sharpening stroke.

Other objects and advantages of the invention will hereinafter appear.

DRAWINGS

DESCRIPTION OF PREFERRED EMBODIMENTS

Figure 1:
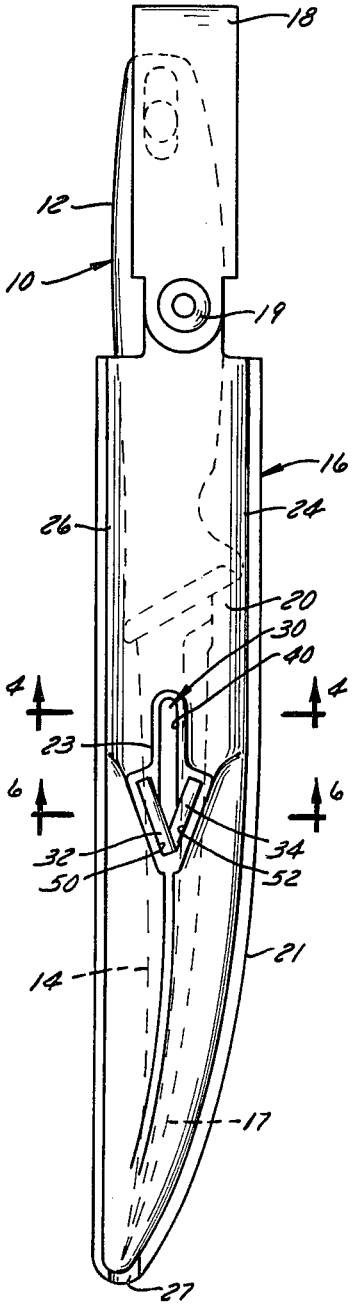
FIG. 1 is an elevation view of one side of a scabbard having knife sharpening means in accordance with the invention and showing a knife in the scabbard.
Figure 2:
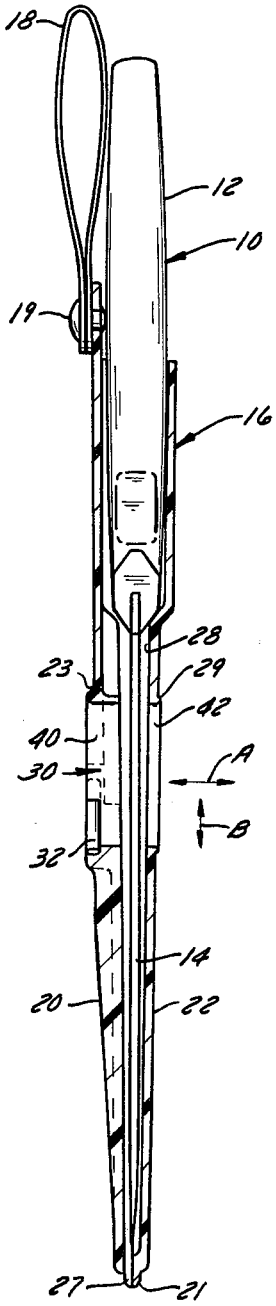
FIG. 2 is a longitudinal cross-section view of the scabbard with an edge view of the knife therein.
Figure 3:
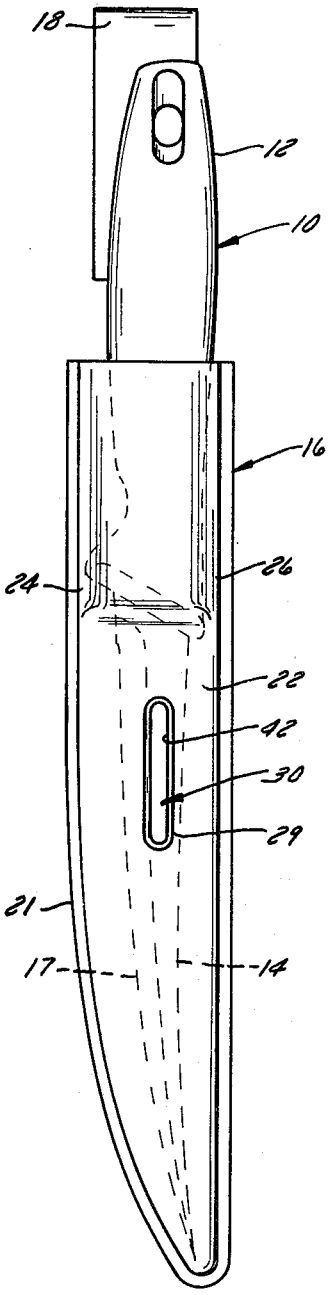
FIG. 3 is an elevation view similar to FIG. 1 but of the opposite side of the scabbard.

Referring to FIGS. 1, 2 and 3, the numeral 10 designates a knife, comprising a handle 12 and a blade 14 having an edge 17, which is disposed in a scabbard 16. Scabbard 16 is shown as having a belt-loop 18 secured thereon by a rivet 19. As FIGS. 1 through 6 show, scabbard 16 is formed by molding of rigid material such as plastic and comprises integrally formed spaced apart side walls 20 and 22 which are joined along their edges by edge walls 24 and 26. If preferred, however, scabbard 16 could be fabricated of other materials, such as leather, wood or metal, and in some other fashion. For convenience, walls 20 and 22 may be considered as inner and outer walls, respectively, in consideration of their positions when the scabbard 16 is being worn by a user. The side walls 20 and 22 and the edge walls 24 and 26 cooperate to define a space or recess 28 for accommodating the entire blade 14 and a portion of handle 12 when knife 10 is placed in scabbard 16. Space 28 has a drain hole 27 at its lower end. Scabbard 16 is shaped so that recess 28 is relatively narrow at its lower portion to more closely conform to the shape of knife blade 14 and is relatively wide at its upper portion to accommodate and frictionally engage a portion of knife handle 12, such frictional engagement aiding in preventing accidental dislodgement of knife 10 from scabbard 16.

Figure 4:
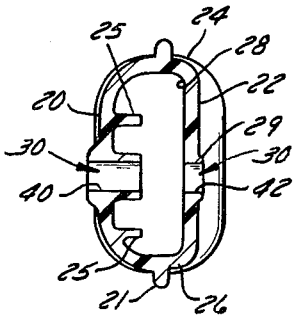
FIG. 4 is a cross-section of the scabbard taken on line 4—4 of FIG. 1.
Figure 5:
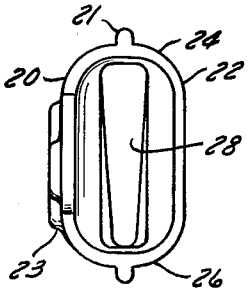
FIG. 5 is a plan view of the upper end of the scabbard with the knife removed therefrom.

Scabbard 16 is provided with integrally formed projections or ribs which serve to strengthen portions of the scabbard or to support the knife sharpening means hereinafter described. Thus as FIGS. 1 through 7 show, scabbard 16 is provided with a rib 21 which extends around the entire peripheral edge of the scabbard. As FIGS. 1, 2, 6, 7, 8 and 9 show, a rib-like structure 23 is provided on the outside of scabbard 16 for the knife sharpening means hereinafter described. As FIGS. 2 and 4 show, internal strengthening ribs 25 are provided inside the scabbard 16 in the vicinity of the sharpening means hereinafter described. As FIGS. 2, 3, 4 and 6 show, a rib 29 is provided around hole 42 in wall 22 to offer additional support surface for the knife blade 14 during a sharpening operation.

In accordance with the invention scabbard 16 is provided with knife blade sharpening means mounted thereon. As FIGS. 1 through 10 show, the knife blade sharpening means generally comprise a blade-receiving sharpening slot, generally designated 30, formed in a portion of the scabbard and blade sharpening abrasive means comprising members 32 and 34 attached to the scabbard 16 and located adjacent the slot 30. The slot 30 is defined by the two aligned holes 40 and 42 in the walls 20 and 22, respectively, and the space therebetween inside the scabbard 16. As FIG. 2 shows, the slot 30 has an axis A transverse to the longitudinal axis B of the scabbard 16. The blade sharpening abrasive members 32 and 34 are located on the scabbard 16 near the sharpening slot 30 in a position for sliding engagement with the edge 17 of knife blade 14 being moved in the sharpening slot to effect sharpening thereof. The blade sharpening members 32 and 34 are fabricated of material harder than the material of which the knife blade 14 is made, such as tool steel or an abrasive, which is capable of sharpening the edge 17 of the knife blade 14. In operation, as FIG. 7 shows, the knife blade 14 is inserted through the slot 30 and moved reciprocably therein (see arrow A in FIG. 7) as the blade edge 17 to be sharpened bears against the blade sharpening members 32 and 34 adjacent the slot 30. Such movement continues until the desired degree of sharpness is attained.

Figure 6:
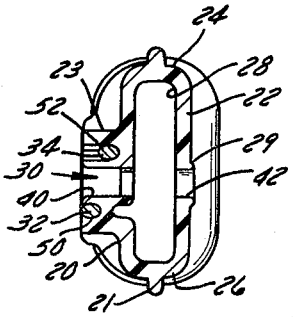
FIG. 6 is a cross-section view of the scabbard taken on line 6—6 of FIG. 1.
Figure 7:
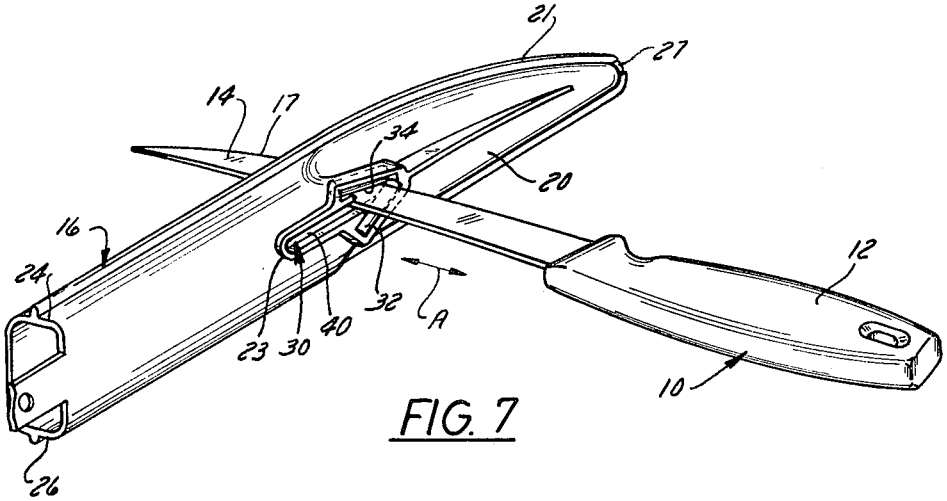
FIG. 7 is a perspective view showing the empty scabbard and a knife blade to be sharpened inserted between sharpening members adjacent a slot through which the blade extends.
Figure 11:
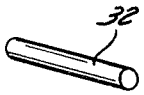
FIG. 11 is a perspective view of one of the sharpening devices of FIG. 8.
Figure 8:
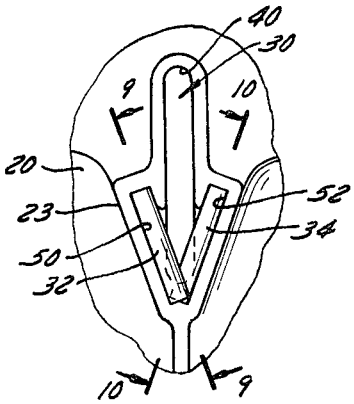
FIG. 8 is an enlarged plan view of the sharpened device shown in FIGS. 1, 2, 6 and 7.
Figure 10:
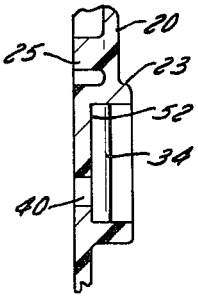
FIG. 10 is a cross-section view taken on line 10—10 of FIG. 8.

As FIGS. 6 and 8 show, in a preferred embodiment of the invention disclosed herein, the knife blade sharpening means comprises two aligned holes 40 and 42 in the scabbard walls 20 and 22, respectively, which define the blade-receiving slot 30. The two blade sharpening members 32 and 34 are located adjacent the slot 30 on one of the scabbard walls, such as inner wall 20. More specifically, knife scabbard 16 comprises the two rigid side walls or members 20 and 22 having the space 28 therebetween for accommodating the blade 14 of knife 10 carried in the scabbard. The side walls 20, 22 have the elongated holes 40, 42, respectively, therethrough which communicate with space 28 and the holes 40, 42 are aligned or in registry with one another to define the slot 30 formed in scabbard 16. Each of the holes 40, 42 is shown as extending lengthwise in the direction of the longitudinal axis B of scabbard 16 and each is about $\frac{1}{3}$ longer than the maximum width of blade 14 so as to be long enough to allow for some tilt of the blade as it moves reciprocably in the slot 30 during sharpening. Slot 30 is closed at both ends.

Referring to FIGS. 6 through 11, the two blade sharpening members 32 and 34 each take the form of a short length, cylindrical in form, of rigid abrasive ceramic material. The members 32 and 34 are mounted at angles to one another on scabbard 16 by being entrapped and secured in depressions 50 and 52 integrally formed as by molding in the structure 23 formed on side 20 of scabbard 16. As FIG. 8 shows, the members 32 and 34 define an acute angle, the corner of which overlies the lower end of slot 30 so that when the knife blade 14 moves in the slot, its edge 17 can make contact with either or both sharpening members 32 or 34. Referring to FIG. 6, the members 32 and 34 are shown as lying in parallel planes, and they are arranged so that one member 32 overlies or crosses the other member 34, for example.

Figure 12:
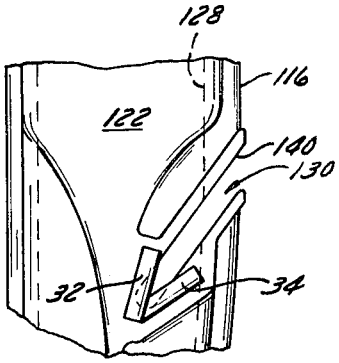
FIG. 12 is a cross-section of a scabbard having knife sharpening means in accordance with a second embodiment of the invention.
Figure 13:
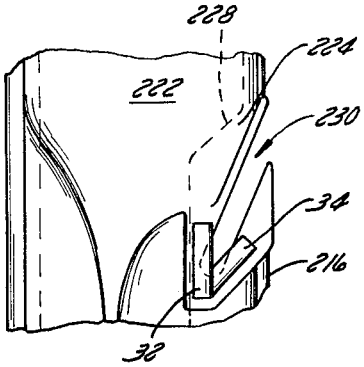
FIG. 13 is a cross-section of a scabbard having knife sharpening means in accordance with a third embodiment of the invention.
Figure 9:
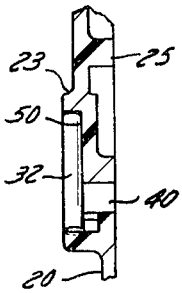
FIG. 9 is a cross-section view taken on line 9—9 of FIG. 8.

Referring now to FIGS. 12 and 13, there are shown two other embodiments of the invention wherein the sharpening slots 130 and 230, respectively, extend into scabbards 116 and 216, respectively, and are open at one end. In FIG. 12, the slot 130 communicates with the knife blade-receiving recess 128 and is defined by a pair of registering elongated holes such as 140 formed in wall 122. In FIG. 13 the slot 230 does not communicate with the interior recess 228 but extends into a solid portion or edge wall 224 formed by joining together of the scabbard side walls such as 222.

In all embodiments of the invention those portions, such as the scabbard side walls 20 and 22, in which the slot 30 is formed are of such a size as to mechanically support or steady the knife blade 14 relative to the sharpening members 32 and 34 during sharpening. Thus, in FIG. 2 the walls 20 and 22 are seen to be spaced apart and thus effect a supporting function. A similar wall arrangement exists in FIG. 12. In FIG. 13, it is to be understood that the thickness of portion 224 is such as to provide good blade support.

Scabbard 16 is shown as having belt-loop 18 secured thereon by a rivet 19 but it is to be understood that the belt-loop 18 could be omitted or, if preferred, other types of means or devices (not shown) could be provided to enable attachment of the scabbard to clothing or gear worn by a user or on the user himself.

I claim:

1. In combination:

a knife scabbard having a pair of spaced apart walls enclosing an elongated recess for receiving and protecting the blade of a knife carried by said scabbard;

and knife blade sharpening means on said scabbard and comprising:

a blade-receiving sharpening slot in said scabbard defined by a pair of registering holes in said scabbard walls, said slot having an axis transverse to the longitudinal axis of said scabbard;

and blade sharpening abrasive means on said scabbard near said sharpening slot for sliding engagement with the edge of a knife blade being moved in said sharpening slot to effect sharpening thereof.

2. A combination according to claim 1 wherein said sharpening slot is closed at both ends.

3. A combination according to claim 1 wherein said sharpening slot is open at one end.

4. A combination according to claim 1 or 2 or 3 wherein said abrasive means comprises at least one abrasive member rigidly secured to said scabbard adjacent said sharpening slot.

5. A combination according to claim 1 or 2 or 3 wherein said abrasive means comprises a pair of abrasive members rigidly secured to said scabbard and disposed in angular relationship relative to each other.

6. A combination according to claim 6 wherein said pair of abrasive members are in overlapped relationship relative to each other.

7. A combination according to claim 5 wherein said pair of registering holes in said scabbard walls communicates with said elongated recess.

* * * * *